US011998132B1

(12) United States Patent
Arafa et al.

(10) Patent No.: US 11,998,132 B1
(45) Date of Patent: Jun. 4, 2024

(54) OUTDOOR ELECTRONIC MOVABLE DELIVERY BOX

(71) Applicant: KING FAISAL UNIVERSITY, Al-Ahsa (SA)

(72) Inventors: Safaa Zaky El-Said Arafa, Al-Ahsa (SA); Mamdouh Mosaad Ahmed Helali, Al-Ahsa (SA); Fatma Mohsen Shalaby, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/444,486

(22) Filed: Feb. 16, 2024

(51) Int. Cl.
*A47G 29/30* (2006.01)
*A47G 29/14* (2006.01)
*E04H 1/04* (2006.01)

(52) U.S. Cl.
CPC ..... *A47G 29/30* (2013.01); *A47G 29/141* (2013.01); *E04H 1/04* (2013.01)

(58) Field of Classification Search
CPC .. A47G 29/30; A47G 29/141; A47G 29/1216; A47G 29/1201; E04H 1/04
See application file for complete search history.

(56) References Cited

U.S. PATENT DOCUMENTS 4,217,833 A 8/1980 Sukolics
4,403,730 A * 9/1983 Batson ..... A47G 29/1216 232/39
10,026,054 B1 * 7/2018 Staton ..... B65D 25/00
11,222,299 B1 1/2022 Baalke et al.
2015/0145643 A1 * 5/2015 Fadell ..... G07C 9/27 340/5.51
2017/0185734 A1 6/2017 Ranieri et al.
2017/0313328 A1 * 11/2017 Phadke ..... B61C 3/00
2018/0049575 A1 * 2/2018 Yamrick ..... A47G 29/141
2018/0092484 A1 * 4/2018 Lewis ..... G08G 5/0026
2019/0039751 A1 * 2/2019 Janssen ..... G08G 5/0069
2019/0125116 A1 * 5/2019 Russell ..... B64C 39/02
2020/0180880 A1 * 6/2020 Gil ..... A47G 29/22
2020/0288895 A1 9/2020 Bennet et al.
2021/0045563 A1 2/2021 Bartley-Clark
2021/0196069 A1 * 7/2021 Likins ..... A47G 29/1218
2021/0284451 A1 * 9/2021 Burchat ..... B65G 11/203
2022/0242560 A1 * 8/2022 Fernandez ..... A47G 29/30
2024/0000256 A1 * 1/2024 Eastman ..... A47G 29/141

FOREIGN PATENT DOCUMENTS

JP H06253968 A * 9/1994

* cited by examiner

*Primary Examiner* — William L Miller
(74) *Attorney, Agent, or Firm* — Nath, Goldberg & Meyer; Richard C. Litman

(57) ABSTRACT

A building mounted delivery management system and associated method is provided which makes use of a movable electronic delivery box (basket) moves in a path outside a multi-story residential building such as an apartment building or other residential high-rise building. The electronic delivery box is accessible only by authorized delivery personnel and correctly identified and authorized residents of the residential building.

7 Claims, 2 Drawing Sheets

OUTDOOR ELECTRONIC MOVABLE DELIVERY BOX

BACKGROUND

1. Field

The present disclosure relates to a building mounted delivery management system and associated method that makes use of a movable electronic delivery box (basket) moves in a path outside a multi-story residential building such as an apartment building or other residential high-rise building.

2. Description of the Related Art

There have been many complications associated with standard package delivery systems and techniques, especially those configured for multi-story residential buildings such as apartments or condominiums. For package delivery, many conventional troubles are known to exist with the process such as dropped packages, package theft, wrong address deliveries and attempts, package exposure to weather, recipient not home, etc.

Where to deliver the items is a difficult problem to solve. How to deliver is another issue as well. How is the delivery company to ensure that the right person gets the package? How is the person to know that the delivery is on time or is ready to be delivered? How does the delivery personnel or even the delivery company know that the delivery attempt has been successful? By what means can one make delivery systems and techniques security foolproof, accountable, dependable, and safe?

What is needed is a method and device for delivering packages that addresses the limitations discussed above where the packages can be delivered to inhabitants in a multi-story residential building without any physical contact between the recipient of the package and the delivery personnel.

SUMMARY

The present subject matter is directed towards an apparatus and methods of operation that are further described in the following Brief Description of Drawings, the Detailed Description, and the claims. Other features and advantages of the present subject matter will become apparent from the following detailed description with reference to the accompanying drawings.

The present disclosure relates to a building mounted delivery management system and associated method that makes use of a movable electronic delivery box (basket) moves in a path outside a multi-story residential building such as an apartment building or other residential high-rise building. This movable electronic delivery box can function in a similar fashion to an externally mounted elevator where the box can be stopped, can be used to lift things or move things down, and can collect things from outside while ensuring minimal physical contact with associated delivery personnel.

In a first aspect of the present subject matter, a system of optimizing package and/or item delivery is implemented with an electronic box being situated external to a building such that it can be lowered or elevated at multiply accessible positions along a vertical support and articulation means. The electronic box comes with a closeable and lockable lid and is a secure drop box that comprises a container portion configured to receive the item, and an access assembly being associated with the container portion that controls access to the container portion.

A second aspect of the present subject matter is a method which, when implemented with the system described herein, performs the function of optimizing delivery of packages or items to inhabitants of a multi-story residential building such as by way of non-limiting example an apartment building or condominium.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF EMBODIMENTS

The following detailed description is merely exemplary in nature and is not intended to limit the described embodiments or the application and uses of the described embodiments. Any implementation described herein with the words "exemplary" or "illustrative" is not necessarily construed as preferred or advantageous over other implementations. All of the implementations described below are exemplary implementations provided to enable persons skilled in the art to make or use the embodiments of the disclosure and are not intended to limit the scope of the disclosure, which is defined by the claims.

For the purposes of the description herein, there is no intention to be bound by any expressed or implied theory presented in the preceding technical field, background, brief summary, or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed therein are not to be considered as limiting, unless the claims or disclosure expressly state otherwise.

Figure 1:
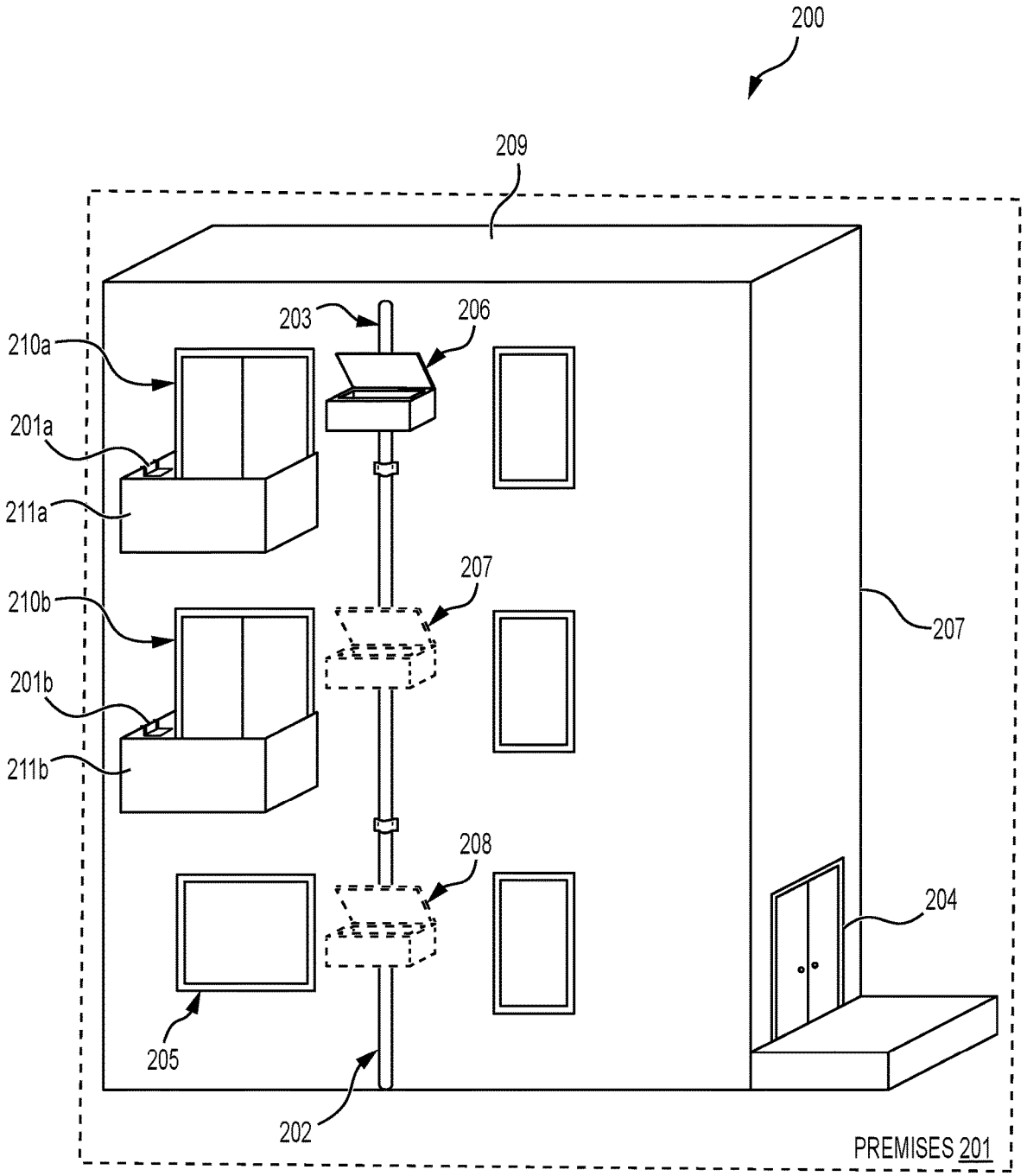
FIG. 1 is a block diagram illustrating a package delivery system which makes use of an electronic box in a multi-unit apartment building where the electronic box delivers products to a user's balcony or apartment window.

FIG. 1 is a block diagram illustrating the use of an electronic box (206) as a part of the package delivery system (200) in a multi-story residential building (209) such as an apartment building or condominium building, however, the premises (201) can be actually be any standard multi-story building from a single family home, duplex, townhouse, office building, and the like. Standard delivery options currently allow delivery personnel to enter through the front door (204) of the building and leave packages in a mail room or even at the front desk of an apartment building. However, the time from when the package gets left to when it is actually picked up can vary greatly given the particular circumstance. If the package is left in a mail room unattended, it is quite possible that the package can be stolen by other residents in the building, and/or people in the building for a particular task, such as service and repair personnel. Additionally, if it is a time sensitive delivery, such as a bouquet of flowers or other perishable items such as food, the longer the item sits without being delivered, the quicker it loses its freshness and vitality.

Accordingly, with the system of FIG. 1, when preselected ahead of time, the delivery option of having the delivery personnel place the item within the electronic box (206), and then having the electronic box (206) deliver the item to multiple floors of the building such as the balconies (211*a*), (211*b*), or ground floor window (205), provides the recipient with the more efficient option of receiving a package without having to leave the security of one's living space, and without having to have any physical contact with the delivery personnel.

As shown in FIG. 1, the electronic box (206) is mounted to a pole (202) which is affixed to a side of the building (209) such that the electronic (206) box moves up and down the pole (202) using a conventional motor affixed between the rear of the electronic box and the pole (206) to raise or lower the electronic box (206) as desired, where the electronic box (206) can be stopped at a topmost position (203) adjacent the topmost balcony (211*a*), a middle position adjacent (207 shown in dashed lines) the first floor balcony (211*b*), and a ground floor position adjacent (208 shown in dashed lines) the ground floor window (205). When not in use the electronic box (206) resides in the topmost position (203) as a default position because this position (203) of the electronic box (206) being elevated from the ground is a safeguard against tampering. While the embodiment of FIG. 1 shows a three-level building, buildings having more than 3 levels, such as 4, 5, 6, or more levels, are further contemplated herein. Likewise, multiple electronic box (206) systems may be employed for a single building, depending on the number of residences, offices, etc. on each for of the building.

For the floors where the electronic box (206) is stopped adjacent to a balcony (211*a*), (221*b*), a user in the upper level units would exit onto the particular balcony through sliding glass doors (210*a*), (210*b*), access the particular control pad (201*a*), (201*b*), and initiate the process of acknowledging the item for delivery by entering an appropriate code in the particular control pad (201*a*), (201*b*) sent to the user by the delivery person ahead of time. Once the correct code is entered, the electronic box (206) would open its lid (as shown, e.g., in the topmost instance of electronic box (206) in FIG. 1) and allow a user to retrieve the items therein. If payment was not managed electronically, then payment for the goods could be returned back down to the delivery person using the electronic box. In this instance, the user could input in a new code for the delivery person to use to open the lid of the electronic box to retrieve payment, or for the sake of simplicity reuse the same code that was assigned to the user by the delivery person.

While the control pads (201*a*), (201*b*) are shown to be mounted on the balcony in an embodiment, in a unit such as the ground floor unit where a balcony is not present, the control pad could be mounted on an interior wall in an area proximal the package receiving window (205), and this control pad would have the same functionality as the other control pads as already discussed above. In addition, the control pads (201*a*), (201*b*) can be used to call the electronic box (206) from its default topmost position (203) to the other lower positions (207), (208) to deliver items down to ground which have nothing to do with a scheduled delivery in much the manner of an externally mounted dumbwaiter.

The control pads (201*a*), (201*b*) can also control the opening and closing of a lid portion of the electronic box (206) where the prompting of a code is not needed. As an additional security feature, one of the multi-story building security cameras can be trained upon the ground floor location of the electronic box (206) so that a visual record of the delivery person depositing the delivery items can be sent to a display on the control pads (201*a*), (201*b*) so that the user can see the items being placed in the electronic box prior to having the box move up the pole to appropriate delivery location (207), (203), or in the case of the ground floor unit, ensure that the delivery person has exited the area and the user of that unit is free to access the box from its location (208). The control pads (201*a*), (201*b*) record lid opening times and lid closing times of the electronic box (206) being opened and closed by a user so that the delivery company can have a record of the user actually having received the item by accessing the electronic box. This feature helps resolves any disputes in the delivery of items from the vendor or customer and be used as a verification means prior to the crediting of any electronic payment from the user to the delivery company.

Figure 2:
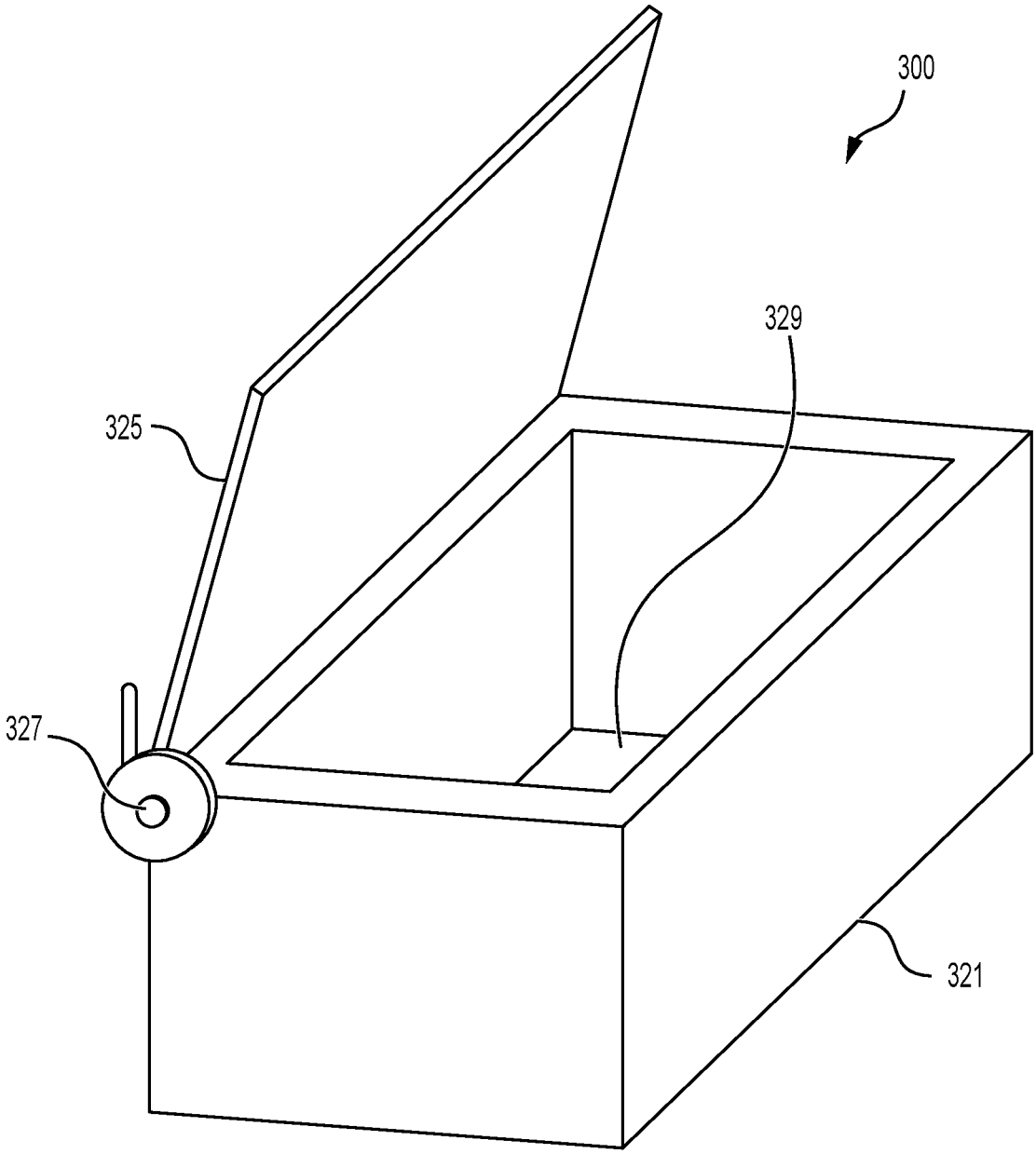
FIG. 2 is a detailed view of the electronic box of the package delivery system.

FIG. 2 shows a detailed view of an electronic box (300). The electronic box (300) comes with a closeable and lockable lid (325) and is a secure drop box that comprises a container portion (329) configured to receive the item, and an access assembly being associated with the container portion that controls access to the container portion. The access assembly takes the form of the lid control (327) which can be securely locked or unlocked by a user's control pad (201*a*), (201*b*), or a delivery person's phone or other company device using access codes, one-time use passwords, etc., as appropriate), by the user's control pads (201*a*), (201*b*), or by a user's connected computer located within the premises (201). The electronic box (300) also comprises an electronic box circuitry (321) comprising a processing circuitry (not shown). The processing circuitry, only after confirming delivery authorization, directs the access assembly to provide access to the container portion (329) to receive the item in the container portion (329). The processing circuitry, only after confirming user authorization which is acknowledged by the user using one of the control pads (201*a*), (201*b*), directs the access assembly to provide access to the user to container portion (329) so that the user can remove the item and return payment if needed.

It is to be understood that the building mounted delivery management system and associated method are not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A building mounted package management system, comprising:

an electronic box kept at a default position;

a pole mounted externally to a multi-story building wherein the pole traverses a height of the multi-story building, wherein the electronic box is mounted on the pole and moves vertically along the pole; and at least one control pad for controlling a position of the electronic box by moving the electronic box from the default position to another vertical position along the pole, wherein the electronic box is mounted on the pole and moves vertically along the pole to positions corresponding to other floors of the multi-story building such that a container space within the electronic box is accessible to a user when the electronic box is vertically positioned at one of the other floors of the multi-story building, and wherein the electronic box is accessible to a user when the electronic box is vertically positioned at one of the other floors of the multi-story building after the user enters a code into the at least one control pad.

2. The building mounted package management system as recited in claim 1, wherein a lid portion of the electronic box is opened after the user enters the code into the at least one control pad.

3. The building mounted package management system as recited in claim 2, wherein a lid opening time and a lid closing time of the electronic box is recorded and stored by the electronic box for a delivery confirmation.

4. The building mounted package management system as recited in claim 1, wherein an image of a delivery person placing an item into the container space within the electronic box is sent to the at least one control pad so that the user can verify that a delivery is ready for the user to access.

5. A building mounted package management method, comprising:

keeping an electronic box at a default position;

engaging the electronic box with a pole externally mounted to a multi-story building, wherein the pole traverses a height of the multi-story building, wherein the electronic box is mounted on the pole and moves vertically along the pole; and using at least one control pad to control a position of the electronic box by moving the electronic box from the default position to another vertical position along the pole, wherein the electronic box is mounted on the pole and moves vertically along the pole to positions corresponding to other floors of the multi-story building such that a container space within the electronic box is accessible to a user when the electronic box is vertically positioned at one of the other floors of the multi-story building, and wherein the electronic box is accessible to a user when the electronic box is vertically positioned at one of the other floors of the multi-story building after the user enters a code into the at least one control pad.

6. The building mounted package management method as recited in claim 5, wherein a lid portion of the electronic box is opened after the user enters the code into the at least one control pad.

7. The building mounted package management method as recited in claim 6, wherein a lid opening time and a lid closing time of the electronic box are recorded and stored by the electronic box for a delivery confirmation.

* * * * *